US007296620B2

(12) United States Patent
Bugler, III et al.

(10) Patent No.: US 7,296,620 B2
(45) Date of Patent: Nov. 20, 2007

(54) HEAT EXCHANGER APPARATUS INCORPORATING ELLIPTICALLY-SHAPED SERPENTINE TUBE BODIES

(75) Inventors: Thomas William Bugler, III, Frederick, MD (US); George Robert Shriver, Sykesville, MD (US); Richard Preston Merrill, Columbia, MD (US)

(73) Assignee: EVAPCO, Inc., Westminster, MD (US)

( * ) Notice: Subject to any disclaimer, the term of this patent is extended or adjusted under 35 U.S.C. 154(b) by 69 days.

(21) Appl. No.: 11/393,677

(22) Filed: Mar. 31, 2006

(65) Prior Publication Data

US 2007/0227712 A1 Oct. 4, 2007

(51) Int. Cl.
*F28D 1/047* (2006.01)

(52) U.S. Cl. ..... 165/150; 165/175; 165/910

(58) Field of Classification Search ..... 165/150, 165/152, 163, 171, 175, 910, 903, 177–179, 165/113; 261/152, 153
See application file for complete search history.

(56) References Cited

U.S. PATENT DOCUMENTS

| | | | | |
|---|---|---|---|---|
| 3,106,958 | A * | 10/1963 | Simpelaar | 165/181 |
| 4,800,955 | A * | 1/1989 | Hagemeister et al. | 165/163 |
| 6,820,685 | B1 * | 11/2004 | Carter et al. | 165/150 |
| 2002/0023744 | A1 * | 2/2002 | Kim et al. | 165/177 |

* cited by examiner

*Primary Examiner*—Teresa J. Walberg
(74) *Attorney, Agent, or Firm*—Rader, Fishman & Grauer PLLC

(57) ABSTRACT

A heat exchanger apparatus includes an inlet header, an inlet connection connected to the inlet header, an outlet header, an outlet connection connected to the outlet header and a plurality of serpentine tube bodies. The plurality of serpentine tube bodies interconnect and are in communication with the inlet header and outlet header. Each serpentine tube body has a plurality of straight tube sections and a plurality of U-shaped return bend sections. Each one of the straight tube sections and each one of the return bend sections have an elliptically-shaped cross-sectional configuration. The plurality of serpentine tube bodies are arranged in a juxtaposed manner with consecutive ones of the serpentine tube bodies contacting each other at a point defining a series of stacked common planes disposed parallel with one another.

7 Claims, 8 Drawing Sheets

HEAT EXCHANGER APPARATUS INCORPORATING ELLIPTICALLY-SHAPED SERPENTINE TUBE BODIES

FIELD OF THE INVENTION

The present invention relates to a heat exchanger apparatus. More particularly, the present invention is directed to a heat exchanger apparatus that incorporates serpentine tube bodies having elliptically-shaped cross-sectional configurations.

BACKGROUND OF THE INVENTION

Commonly known in the art in the fabrication of the heat exchangers, straight tubes are bent in an approximate range of bend angles of 170° and 190° so as to form a unitary construction of two straight tube sections integrally connected with a return bend formed at a selected bend angle. A skilled artisan would appreciate that if the straight tube is bent precisely 180°, the two straight tube sections would extend parallel to one another while if the straight tube is bent at a selected bend angle anywhere in the approximate range other than 180°, the straight tube sections would extend generally parallel with one another. For simplicity, the term "generally parallel" shall refer to the relationship of the two straight tube sections after the straight tube is bent at any selected angle in the approximate range of 170° and 190° including the precise bend angle of 180°.

By way of example only, variations of a conventional heat exchanger are illustrated in FIGS. 1-6. Although not by way of limitation, a conventional heat exchanger 100 in FIG. 1 includes an upper inlet manifold 102 and a lower outlet manifold 104. A skilled artisan would appreciate that the inlet manifold and the outlet manifold can switch locations such that the inlet manifold is located at the bottom of the conventional heat exchanger 100 and considered a lower inlet manifold while the outlet manifold is located at the top of the conventional heat exchanger 100 and considered an upper outlet manifold. The manifolds 102 and 104 are held in place by a bracket 106*a* on a side wall 108*a*. Inlet and outlet fluid conduits 110 and 112 extend through the side wall 108*a* and communicate with the upper and lower manifolds 102 and 104 respectively. A plurality of serpentine heat exchanger tubes 114 are connected between the upper and lower manifolds 102 and 104. The serpentine heat exchanger tubes 114 are arranged relative to each other in a vertically-staggered array as illustrated in FIGS. 2A, 3A and 4.

Each serpentine heat exchanger tube 114 includes a plurality of straight tube sections 116 and a plurality of return bends 118. The plurality of straight tube sections 116 are arranged in a plurality of generally parallel rows and disposed in a common plane as is known in the art. The plurality of return bends 118 are connected to the plurality of straight tube sections 116 in a manner such that a respective one of the return bends 118 connects sequential ones of the plurality of straight tube sections 116 to form a serpentine configuration. To support the serpentine heat exchanger tubes 114, horizontally extending support rods 120 are mounted on brackets 106*a* and 106*b*. A respective one of the brackets 106*a* and 106*b* is mounted on respective ones of the side walls 108*a* and 108*b*.

Various cross-sectional configurations of the serpentine heat exchanger tubes 114 as is known in the prior art and any selected ones of the various cross-sectional configurations can be employed as shown in FIGS. 2A-6. In FIGS. 2A and 2B, the cross-sectional configuration of the serpentine heat exchanger tubes 114 is circular. Specifically, both the straight tube sections 116 and the return bends 118 are circular in cross-section. By way of example, the circular cross-sectional serpentine heat exchanger tubes 114 occupy an imaginary heat exchange box B. As best shown in FIG. 2B, consecutive ones of the serpentine heat exchanger tubes 114 contact each other at juxtaposed return bends 118 at respective points Pt.

In FIGS. 3A and 3B, the cross-sectional configuration of the serpentine heat exchanger tubes 114 is partially circular and partially elliptical. Specifically, the straight tube sections 116 are elliptical in cross-section and the return bends 118 are circular in cross-section. As shown in FIG. 3B, consecutive ones of the serpentine heat exchanger tubes 114 contact each other at juxtaposed return bends at respective points Pt.

In FIGS. 4-6, the cross-sectional configuration of the serpentine heat exchanger tubes 114 is generally circular. Specifically, the straight tube sections 116 are circular in cross-section and the return bends 118 are primarily circular in cross-section. The return bends 118 are considered primarily circular because each return bend includes at least one dimple 122 that defines a recess 124 formed into the return bend 118 as best shown in FIG. 6. In FIG. 4, the recess 124 is sized to receive a portion of the adjacent return bend 118 in such a manner that surface-to-surface contact is made between contacting return bends. Such surface-to-surface contact slightly reduces heat exchange capacity of the heat exchanger incorporating this structure and might result in corrosion at a level greater than point contact between contacting return bends. However, this design provides a higher density of packing of the serpentine heat exchanger tubes 114 into an identical space of the heat exchanger packed with circular serpentine heat exchanger tubes 114. By way of example, the circular cross-sectional serpentine heat exchanger tubes 114 in FIG. 2A occupy and define the imaginary heat exchange box B. In FIG. 4, the four heat exchanger tubes 114 are packed in the imaginary heat exchange box B sized identically as the one in FIG. 2B. One of ordinary skill in the art would appreciate that the structure in FIG. 4 is more densely packed into the imaginary heat exchange box B because the recesses 124 formed by the dimples 122 in the respective return bends 118 receive the juxtaposed contacting one of the return bends 118.

Because the heat exchanger tubes 114 are more densely packed in the imaginary heat exchange box B, more heat exchanger tubes can be added to an identically-sized heat exchanger thereby increasing heat exchange capacity.

It would be advantageous to provide a heat exchanger incorporating serpentine heat exchanger tubes that result in a densely-packed heat exchanger. It would be advantageous to provide a heat exchanger incorporating serpentine heat exchanger tubes that provides point contact with consecutive ones of the return bends while simultaneously providing a densely packed heat exchanger. The present invention provides these advantages.

OBJECTS AND SUMMARY OF THE INVENTION

An object of the present invention is to provide a heat exchanger apparatus incorporating serpentine tube bodies that result in a densely-packed heat exchanger.

Another object of the present invention is to provide a heat exchanger apparatus incorporating serpentine tube bodies that provide point contact with consecutive ones of the return bends while simultaneously providing a densely-packed heat exchanger.

A heat exchanger apparatus of the present invention is hereinafter described that includes an inlet header, an inlet connection connected to the inlet header, an outlet header, an outlet connection connected to the outlet header and a plurality of serpentine tube bodies. The plurality of serpentine tube bodies interconnect and are in communication with the inlet header and outlet header. Each serpentine tube body has a plurality of straight tube sections and a plurality of U-shaped return bend sections. The plurality of straight tube sections are arranged in a plurality of generally parallel rows and disposed in a common plane with the return bend sections. The plurality of return bend sections are connected to the plurality of straight tube sections in a manner such that a respective one of the return bend sections connects sequential ones of the plurality of straight tube sections to form a serpentine configuration. Each one of the straight tube sections and each one of the return bend sections have an elliptically-shaped cross-sectional configuration. The plurality of serpentine tube bodies are arranged in a juxtaposed manner with consecutive ones of the serpentine tube bodies contacting each other to define a series of stacked common planes disposed parallel with one another.

These objects and other advantages of the present invention will be better appreciated in view of the detailed description of the exemplary embodiments of the present invention with reference to the accompanying drawing figures.

DETAILED DESCRIPTION OF THE EXEMPLARY EMBODIMENTS

Hereinafter, the exemplary embodiment of the present invention will be described with reference to the attached drawings.

Figure 7:
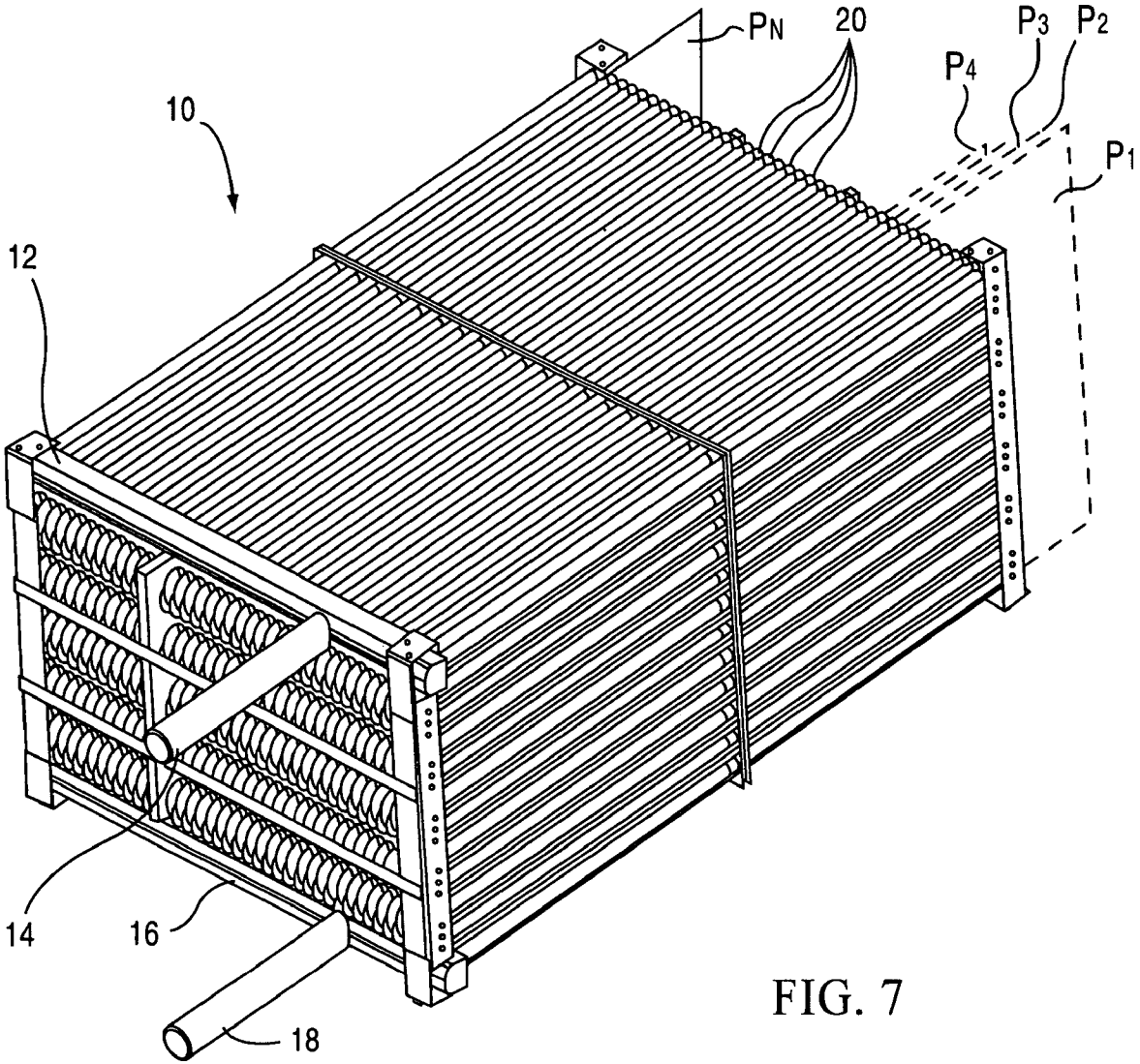
FIG. 7 is a perspective view of an exemplary embodiment of a heat exchanger apparatus of the present invention.
Figure 8:
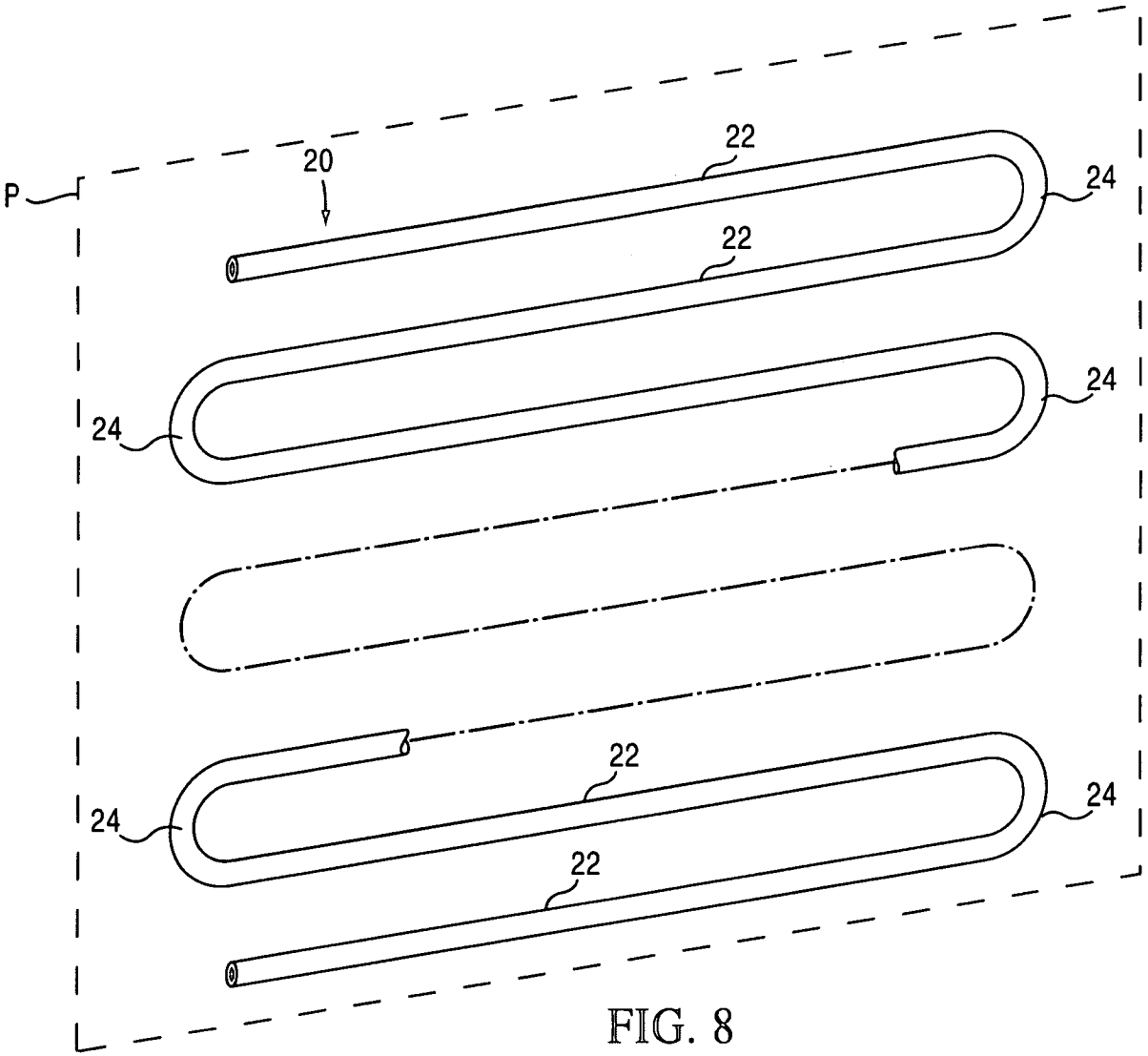
FIG. 8 is a perspective view of a serpentine tube body as a component of the heat exchanger apparatus of the present invention.
Figure 9:
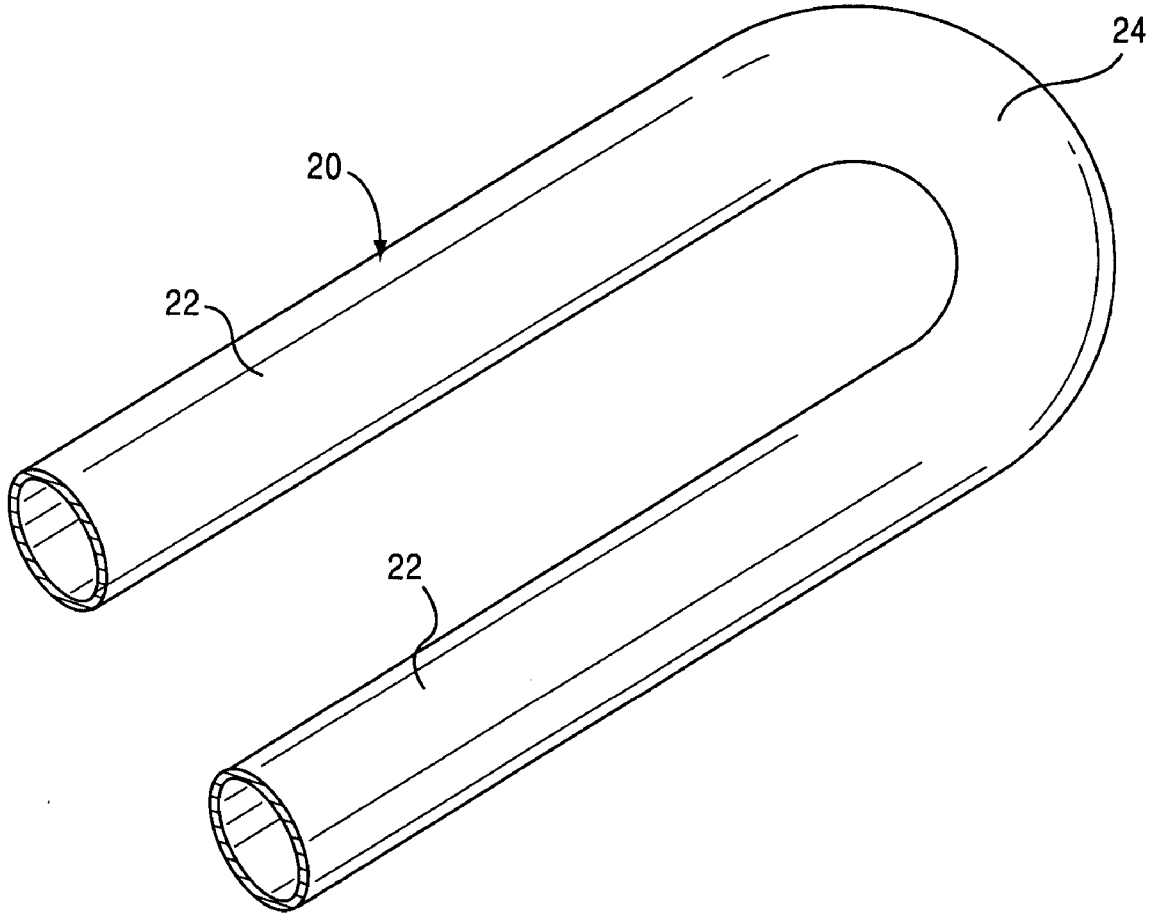
FIG. 9 is a partial perspective view partially in cross-section of the serpentine tube body in FIG. 8.
Figure 10:
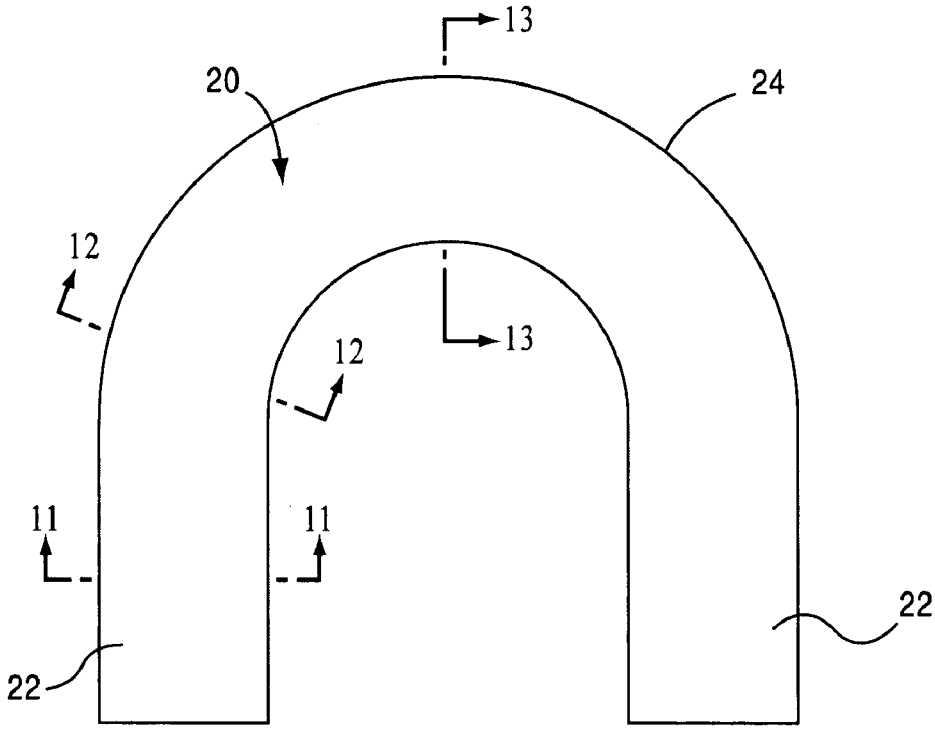
FIG. 10 is a top planar view of the serpentine tube body in FIG. 9.

An exemplary embodiment of a heat exchanger apparatus 10 of the present invention is hereinafter described with reference to FIGS. 7-16. With reference to FIG. 7, the heat exchanger apparatus 10 of the present invention includes an inlet header 12, an inlet connection 14 connected to the inlet header 12, an outlet header 16, an outlet connection 18 connected to the outlet header 16 and a plurality of serpentine tube bodies 20. The plurality of serpentine tube bodies 20 interconnect and are in communication with the inlet header 12 and outlet header 16. With reference to FIGS. 8-13, each serpentine tube body 20 has a plurality of straight tube sections 22 and a plurality of U-shaped return bend sections 24. As shown in FIG. 8, the plurality of straight tube sections 22 are arranged in a plurality of generally parallel rows and disposed in a common plane P along with the return bend sections 24 as shown in FIG. 8. The plurality of return bends 24 are connected to the plurality of straight tube sections 22 in a manner such that a respective one of the return bend sections 24 connects sequential ones of the plurality of straight tube sections 22 to form a serpentine configuration as illustrated in FIG. 8. With reference to FIGS. 9-15, each one of the straight tube sections 22 and each one of the return bend sections 24 have an elliptically-shaped cross-sectional configuration.

In FIG. 7, the plurality of serpentine tube bodies 20 are arranged in a juxtaposed manner. Illustrated in more detail in FIGS. 14-16, consecutive ones of the serpentine tube bodies 20 contact each other. Again, with reference to FIG. 7, the consecutive ones of the serpentine tube bodies 20 define a series of stacked common planes P1 through Pn that are disposed parallel with one another.

As best shown in FIGS. 10-13, the elliptically-shaped cross-sectional configuration of the serpentine tube body 20 is generally constant. More particularly, each one of the straight tube sections 22 and the return bend sections 24 of each serpentine tube body 20 is generally constant. One of ordinary skill in the art would appreciate that, in practice, it would be difficult to maintain an identical cross-sectional configuration of the straight tube sections 22 and the return bend sections 24 because the return bend sections 24 are formed conventionally by bending a straight elliptically-shaped tube about a bend die. Thus, variations of the elliptically-shaped cross-sectional configuration might exist and therefore the elliptically-shaped cross-sectional configuration of the serpentine tube body 20 is considered to be generally constant.

Furthermore, the term "elliptically-shaped" shall be defined to include "oval-shaped" since by definition found in The American Heritage College Dictionary, third edition, "oval" is defined as resembling an ellipse in shape. A skilled artisan would appreciate that in view of FIGS. 9 and 11-15, the cross-sectional shape of the serpentine tube body or bodies 20 can be construed as either "elliptically-shaped" or "oval-shaped". In other words, the term "elliptically-shaped" can be construed as "generally elliptically-shaped".

Figure 11:
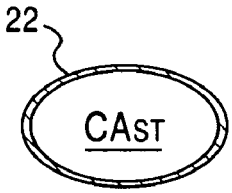
FIG. 11 is a cross-sectional view of the serpentine tube body taken along line 11-11 in FIG. 10.
Figure 12:
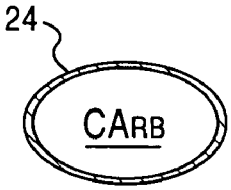
FIG. 12 is a cross-sectional view of the serpentine tube body taken along line 12-12 in FIG. 10.
Figure 13:
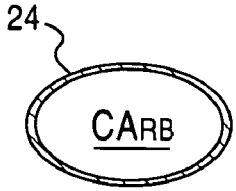
FIG. 13 is a cross-sectional view of the serpentine tube body taken along line 13-13 in FIG. 10.

In FIG. 11, the straight tube section 22 defines an internal straight tube cross-sectional area CAst and, in FIGS. 12 and 13, the return bend section 24 defines an internal return bend cross-sectional area CArb. It is appreciated that each straight tube section 22 of each one of the serpentine tube bodies 20 also has internal straight tube cross-sectional areas CAst's and each return bend section 24 of each serpentine tube bodies 20 also has internal return bend cross-sectional areas CArt's. The internal straight tube cross-section area CAst and the internal return bend cross-sectional area CArb are generally equal in size relative to one another. One of ordinary skill in the art would appreciate that, in practice, it would be difficult to maintain identical internal straight tube cross-section areas Cast's and internal return bend cross-sectional areas CArb's because, as mentioned above, the return bend sections 24 are formed conventionally by bending a straight elliptically-shaped tube about a bend die. Thus, variations of the internal straight tube cross-sectional areas Cast's and the internal return bend cross-sectional areas CArb's might exist and therefore the internal straight tube cross-section areas Cast's and the internal return bend cross-sectional areas CArb's are considered generally equal in size relative to one another.

Figure 14:
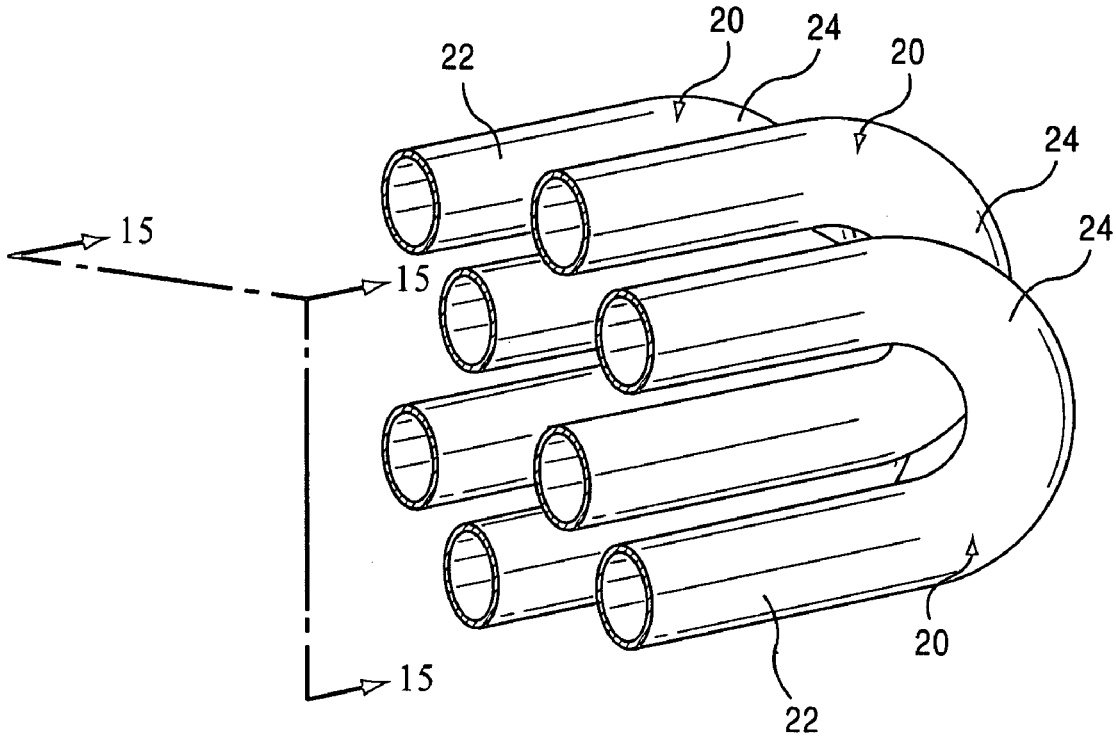
FIG. 14 is a partial perspective view of four prior serpentine tube bodies illustrated in FIGS. 8-10.
Figure 15:
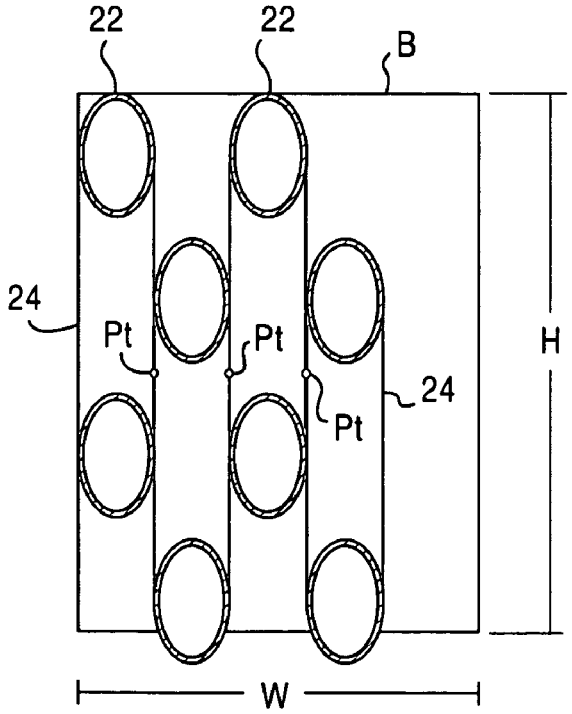
FIG. 15 is a cross-sectional view of the four serpentine tube bodies taken along lines 15-15-15 in FIG. 14.
Figure 16:
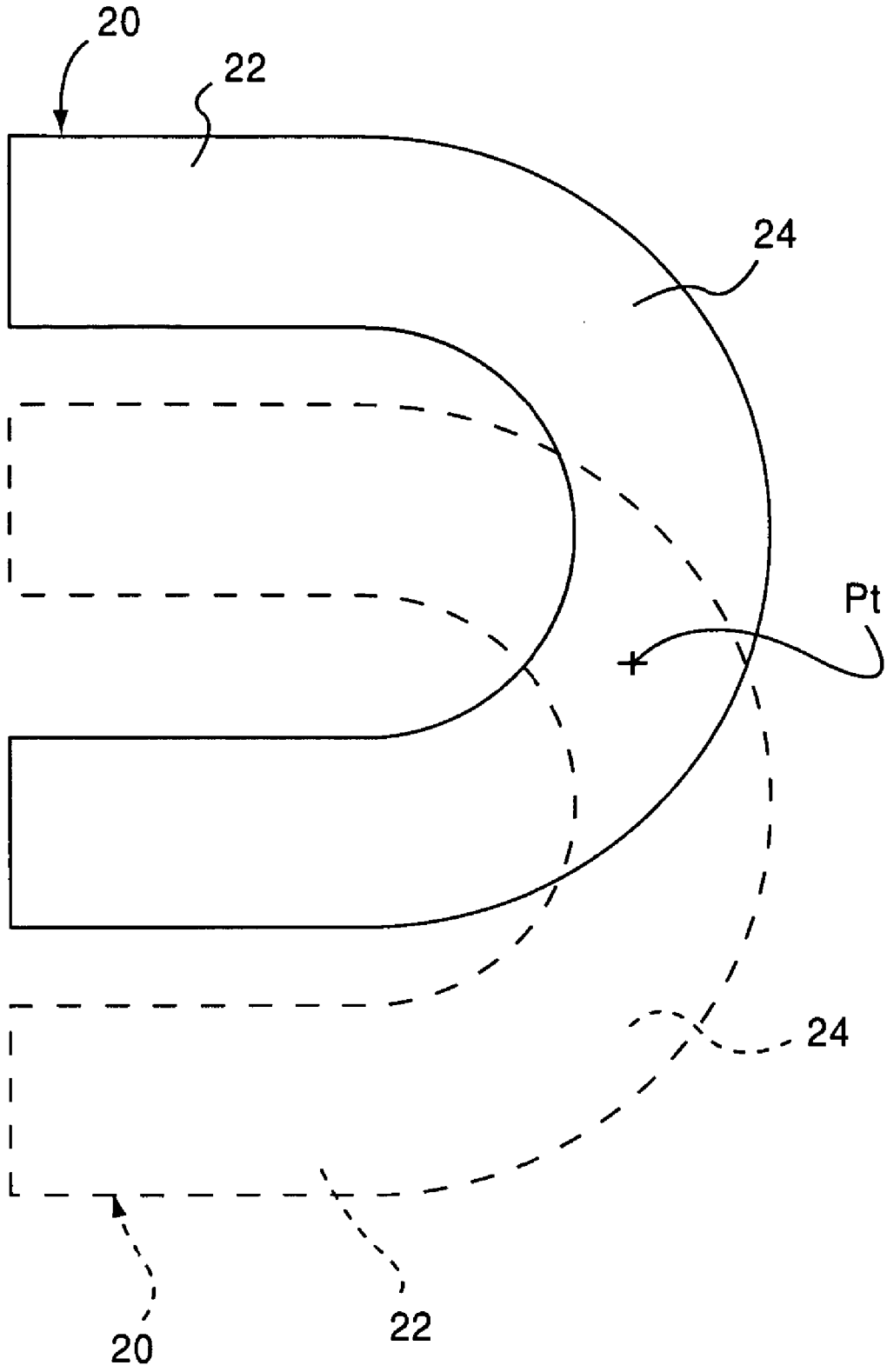
FIG. 16 is a side elevational view of two serpentine tubes illustrated in FIGS. 8-10 arranged in a vertically staggered manner and contacting each other at a point.

Referring to FIGS. 14-16, a plurality of serpentine tube bodies 20 are arranged juxtaposed to one another and consecutive ones of the plurality of serpentine tube bodies 20 are vertically staggered relative to each other. Further, as best shown in FIGS. 15 and 16, consecutive ones of the return bend sections 24 contact each other at points Pt.

Figure 2A:
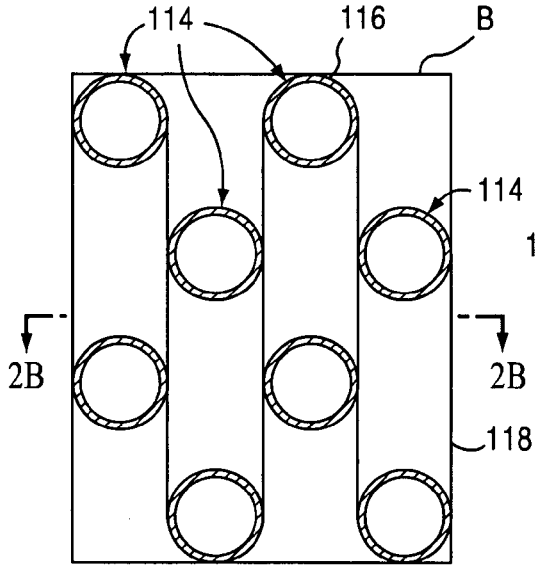
FIG.2A PRIOR ART
FIG. 2A is a cross-sectional view of the four prior art serpentine tube bodies in FIG. 1 having circular cross sections.
Figure 3A:
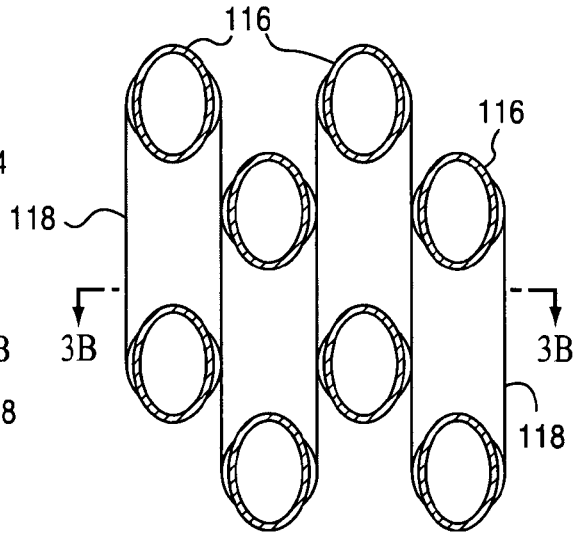
FIG.3A PRIOR ART
FIG. 3A is a cross-sectional view of the four prior art serpentine tube bodies in FIG. 1 having alternate cross-sectional configurations, namely elliptically-shaped straight tube sections connected together with circularly-shaped return bend sections.

Superimposing the imaginary heat exchange box B referred to in FIG. 2A, note that the four serpentine tube bodies 20 occupy only a portion of the imaginary heat exchange box B as viewed from left to right. Also, small portions of the straight tube sections 22 of only two of the four serpentine tube bodies 20 project slightly outwardly from the imaginary heat exchange box B. In any regard, the additional space is available within the imaginary heat exchange box B to include additional serpentine tube bodies 20 if desired. As is known in the art, adding such additional serpentine tube bodies 20 in the imaginary heat exchange box B will increase heat exchange capacity of the heat exchanger apparatus 10 without increasing a width W of the imaginary heat exchange box B but slightly adding to a height H of the imaginary heat exchange box B.

Figure 1:
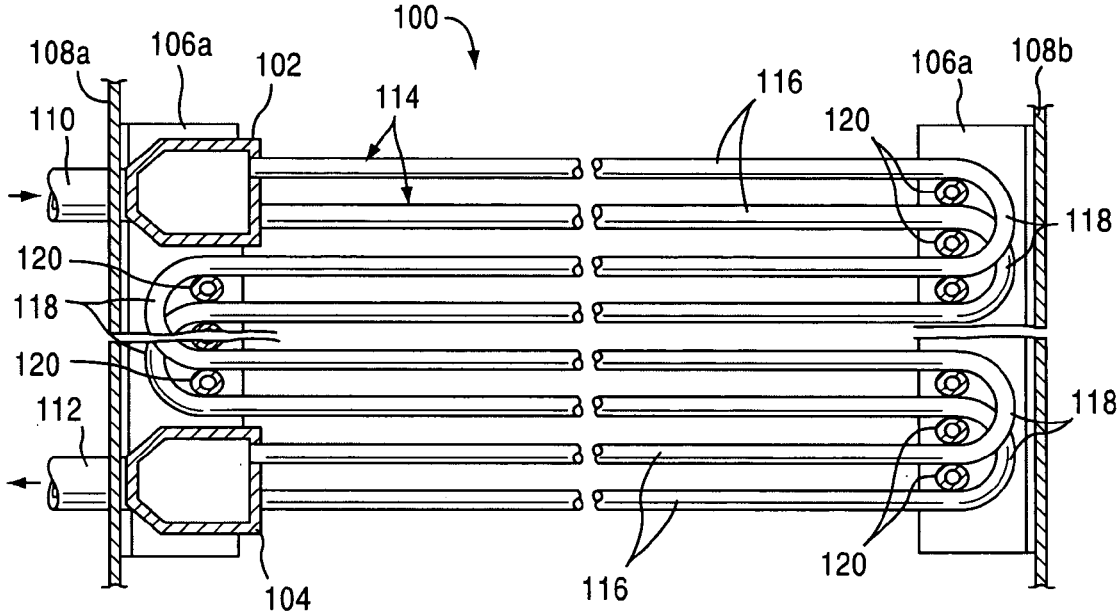
FIG.1 PRIOR ART
FIG. 1 is a side elevational view partially in cross-section of a prior art heat exchanger apparatus incorporating serpentine tube bodies.
Figure 2B:
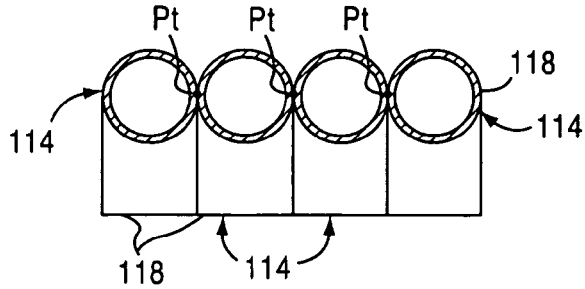
FIG.2B PRIOR ART
FIG. 2B is a cross-sectional view of the four serpentine tube bodies taken a long line 2B-2B in FIG. 2A.
Figure 3B:
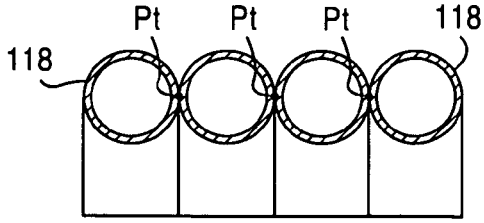
FIG.3B PRIOR ART
FIG. 3B is a cross-sectional view of the four serpentine tube bodies taken a long line 3B-3B in FIG. 3A.
Figure 4:
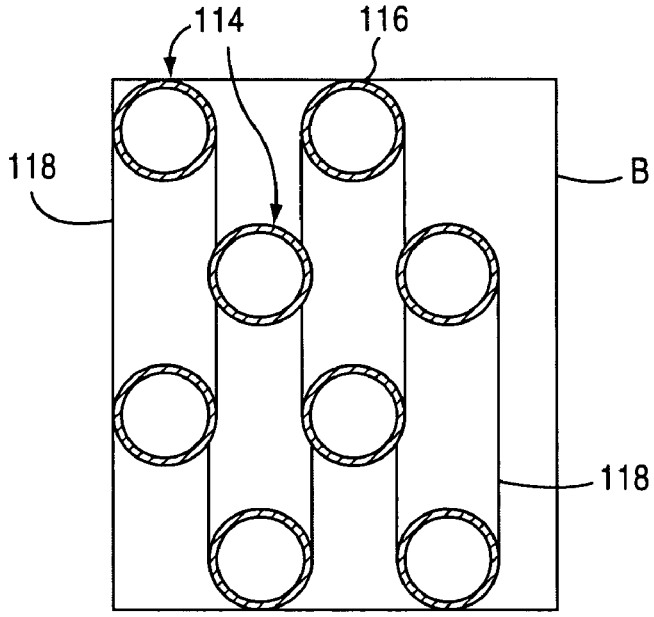
FIG.4 PRIOR ART
FIG. 4 is a cross-sectional view of the four prior art serpentine tube bodies in FIG. 1 having alternate cross-sectional configurations, namely circularly-shaped return bend sections and circularly-shaped straight tube sections with dimples formed in the circularly-shaped return bend sections.
Figure 5:
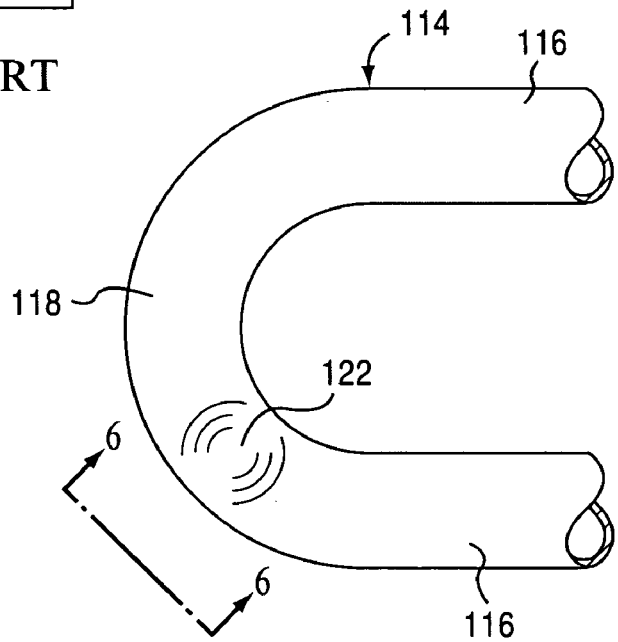
FIG.5 PRIOR ART
FIG. 5 is a side elevational view of the prior art serpentine tube body in FIG. 4.
Figure 6:
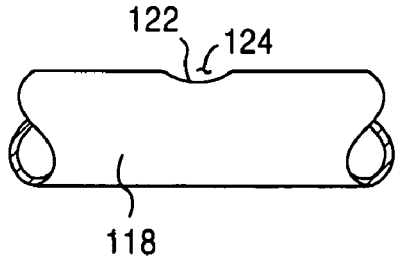
FIG.6 PRIOR ART
FIG. 6 is a partial side elevational view of the prior art serpentine tube body taken a long line 6-6 in FIG. 5.

By comparison of the prior art heat exchanger 100 in FIGS. 1, 2A and 2B with the heat exchanger apparatus 10 of the present invention, empirical data indicates that the heat exchange surface area increases by approximately 23% and that heat transfer improves within a range of approximately 3% and 19%.

The heat exchanger apparatus of the present invention incorporating elliptically-shaped serpentine tube bodies result in a densely-packed heat exchanger providing increased heat exchange surface area and improved heat transfer properties. The heat exchanger apparatus of the present invention incorporating elliptically-shaped serpentine tube bodies provides point contact with consecutive ones of the return bends. Such point contact between consecutive ones on the return bends minimizes concerns for corrosion relative to the densely-packed conventional heat exchanger described in FIGS. of 4-6. Further, since the elliptically-shaped return bend sections are the same shape as the elliptically-shaped straight tube sections, there is an increased heat exchange efficiency higher than the prior art described herein. It is theorized that an increase in heat exchange efficiency occurs because the elliptically-shaped return bend sections are now as aerodynamically beneficial as the aerodynamic elliptically-shaped straight tube sections. It is further theorized that at least a portion of the elliptically-shaped return bend sections are aerodynamically aligned in a direction of flow of the fluid medium which might also contribute to the increased heat exchange efficiency.

The exemplary embodiment of the present invention, may, however, be embodied in various different forms and should not be construed as limited to the exemplary embodiment set forth herein; rather, the exemplary embodiment is provided so that this disclosure will be thorough and complete and will fully convey the scope of the present invention to those skilled in the art. Further, it is appreciated that all of the objects of the present invention may not be encompassed in each one of the claims.

What is claimed is:

1. A heat exchanger apparatus, comprising:

an inlet header;

an inlet connection connected to the inlet header;

an outlet header;

an outlet connection connected to the outlet header; and a plurality of serpentine tube bodies interconnecting and in communication with the inlet header and outlet header, each serpentine tube body having a plurality of straight tube sections and a plurality of U-shaped return bend sections, the plurality of straight tube sections arranged in a plurality of generally parallel rows, the plurality of return bend sections connected to the plurality of straight tube sections in a manner such that a respective one of the return bend sections connects sequential ones of the plurality of straight tube sections to form a serpentine configuration, each one of the straight tube sections and each one of the return bend sections having an elliptically-shaped cross-sectional configuration, the plurality of serpentine tube bodies arranged in a juxtaposed manner with consecutive ones of the serpentine tube bodies contacting each other to define an interfacing plane, and with respective ones of the plurality of straight tube sections and the plurality of return bend sections of one of the consecutive ones of the serpentine tube bodies and respective ones of the plurality of straight tube sections and the plurality of return bend sections of a next one of the consecutive ones of the serpentine tube bodies each being coexistent with the interfacing plane.

2. A heat exchanger apparatus according to claim 1, wherein the elliptically-shaped cross-sectional configuration of each one of the straight tube sections and the return bend sections is generally constant.

3. A heat exchanger apparatus according to claim 1, wherein each one of the straight tube sections defines an internal straight tube cross-section area, the return bend section defines an internal return bend cross-sectional area, the internal straight tube cross-section area and the internal return bend cross-sectional area are generally equal in size relative to one another.

4. A heat exchanger apparatus according to claim 3, wherein the elliptically-shaped cross-sectional configuration of each one of the straight tube sections and the return bend sections is generally constant.

5. A heat exchanger apparatus according to claim 3, wherein consecutive ones of the return bend sections contact each other.

6. A heat exchanger apparatus according to claim 5, wherein consecutive ones of the return bends contact each other at a point.

7. A heat exchanger apparatus according to claim 1, wherein consecutive ones of the plurality of serpentine tube bodies are vertically staggered relative to each other.

* * * * *